United States Patent [19]

Wojtowicz

[11] 4,146,814

[45] Mar. 27, 1979

[54] PINCH AND BASE STRUCTURE FOR SINGLE-ENDED LAMPS

[75] Inventor: Joseph J. Wojtowicz, Novelty, Ohio

[73] Assignee: General Electric Company, Schenectady, N.Y.

[21] Appl. No.: 901,598

[22] Filed: May 1, 1978

[51] Int. Cl.[2] ..... H01J 61/36; H01K 1/42

[52] U.S. Cl. ..... 313/220; 313/222; 313/318; 339/144 R

[58] Field of Search ..... 313/318, 51, 220, 222; 339/144 R, 144 T

[56] References Cited

U.S. PATENT DOCUMENTS

| | | | |
|---|---|---|---|
| 3,256,507 | 6/1966 | Ackerman | 339/144 R |
| 3,256,508 | 6/1966 | Malm | 339/144 |
| 3,441,778 | 4/1969 | Deiss | 313/318 |
| 3,510,718 | 5/1970 | Vetere | 313/318 |
| 3,961,216 | 6/1976 | Edwards | 313/318 X |
| 4,011,642 | 3/1977 | Meinecke et al. | 29/25.16 |

*Primary Examiner*—Palmer C. Demeo

*Attorney, Agent, or Firm*—Paul F. Wille; Lawrence R. Kempton; Frank L. Neuhauser

[57] ABSTRACT

A pinch and base structure is described in which the shaped end of a single-ended miniature lamp is securely engaged by a two piece, clip type base.

7 Claims, 3 Drawing Figures

Fig. 1
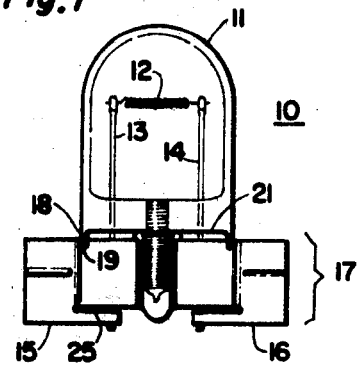
Fig. 2
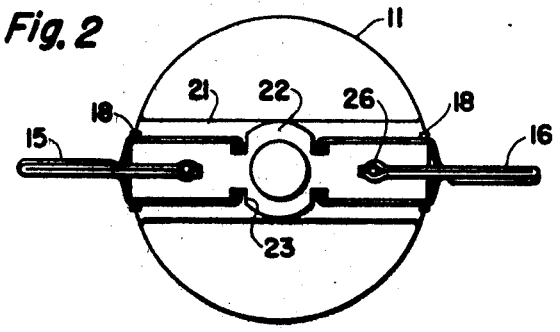
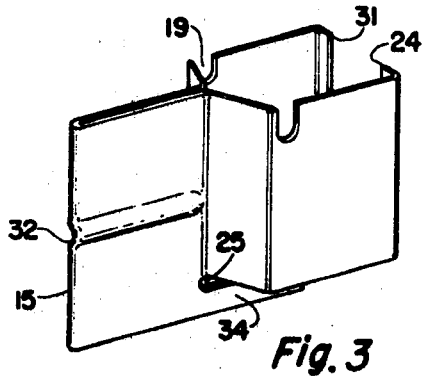
Fig. 3

PINCH AND BASE STRUCTURE FOR SINGLE-ENDED LAMPS

This invention relates to single ended miniature lamps of the type used in automobiles for indicators or illumination and, in particular, relates to single ended lamps for use as the inner bulb in a headlamp.

In the prior art, a wide variety of bases have been proposed to connect the relatively frail lead wires of a lamp to a socket or connector. While these proposals may be generally adequate, few can be used to fasten the inner bulb in a PAR (parabolic aluminized reflector) lamp since the inner bulb must remain in a fixed position relative to the reflector in order to retain the beam pattern of the lamp.

One prior art proposal entails the use of a ceramic base having pins therein and to which a wire lamp is attached to provide the inner bulb. However, the shelf life and cost of suitable basing cements and the cost of the ceramic base are serious drawbacks from a manufacturing viewpoint.

Another proposal in the prior art utilizes metal clips connected to the long side of the rectangular pinch area and relies on projections of glass from the pinch area to secure the envelope to the clips through corresponding apertures in the clips. These projections do not secure the envelope over an appreciable distance along the axis of the lamp. Thus, during shock or vibration, the positioning of the cantilever mounted lamp is dependent on the closeness of fit of the remainder of the clip. This, in turn, depends on the manufacturing tolerances of the various lamp components. Since there is, of necessity, some latitude to enable parts to fit, some lamps are going to be more susceptible to shock or vibration damage than others.

In view of the foregoing, it is therefore an object of the present invention to provide an improved base for single ended lamps.

Another object of the present invention is to provide an improved base for the inner bulb in a PAR lamp.

A further object of the present invention is to provide an improved clip type metal base.

Another object of the present invention is to provide a clip type of base for securely fastening to the shaped pinch end of a lamp.

The foregoing objects are achieved in the present invention wherein there is provided a single ended lamp having the pinch thereof shaped with longitudinal ribs and channels which respectively engage slots and tangs in the metal base clips. The base comprises two of these clips each of which engage a short side of the rectangular pinch end. After the clip is put on the lamp, a portion of each clip is attached to a lead wire, eg. by crimping, thereby securing the base to the lamp.

A more complete understanding of the present invention can be obtained by considering the following detailed description in conjunction with the accompanying drawings, in which:

FIG. 1 illustrates a preferred embodiment of a lamp in accordance with the present invention.

FIG. 2 is an end view of a lamp in accordance with the present invention.

FIG. 3 is a perspective view of one half of a metal base in accordance with the present invention.

As illustrated in FIG. 1, a lamp in accordance with the present invention comprises a single ended pinch seal lamp having clips or sleeves attached to the shaped press seal thereof for connection to a suitable source of power. Specifically, lamp 10 comprises a transparent, vitreous envelope 11, which may comprise glass or quartz, enclosing filament 12 and lead wires 13 and 14 which have the inner ends thereof attached to filament 12, for example by welding or clamping. Further details of a miniature lamp suitable for use in the present invention may be obtained for example from U.S. Pat. No. 3,798,491 — Malm.

Clips or sleeves 15 and 16 are attached to pressed end 17 of lamp 10 to provide a connection between the lamp and a suitable source of power. The configuration of pressed end 17 may be better understood by also considering FIG. 2 which illustrates an end view thereof. As illustrated in FIG. 2, press end 17 comprises an elongated rectangular cross section having transversely extending ridges 18 and channels 23. Ridges 18 extend from shoulder 21 to engage slots 19 in the respective clips, while channels 23 receive inwardly extending tangs 24 from each clip. Envelope 11 is thus securely held against a twisting motion about any axis both by the engagement of ridge 18 in notch 19 as well as the engagement of the enlarged portion of the clip against the outside of the envelope in the direction of the axis of the lamp.

Inwardly extending tangs 24 further stabilize the lamp, in addition to preventing the clip from being pulled off the lamp in a radial direction. To prevent clips 15 and 16 from being removed in an axial direction, and also to provide electrical contact to the lead wires, the lower portion of each clip is fastened to a lead wire for example by welding or crimping at the lower end 26 of each lead wire. This portion of the clip is separated from the enlarged portion of a suitable notch or cut-out 25.

Thus, when attached to the lamp, clips 15 and 16 provide a means for securely mounting the lamp in addition to providing electrical contact with the relatively delicate lead wires. Further by their construction, clips 15 and 16 substantially reduce any forces which might be otherwise applied to the lead wires due to the way in which the lamp is mounted. Specifically, loading forces on envelope 11 are borne by the tab portions of clips 15 and 16 rather than by the lead wires at the connections thereof to the respective clips.

FIG. 3 illustrates an enlarged view of a clip in accordance with the present invention. Specifically, each clip comprises a rectangular, conductive sheet, such as brass or plated steel, which is suitably cut or notched and bent to provide mirror image halves. The sheet is then folded in half along the line of reflection to produce a clip having an enlarged portion for enclosing a short side of the press seal of the lamp and a straight portion for electrical/mechanical contact with the lead wires from the lamp.

Specifically, a clip such as clip 15 is provided with cut-outs or notches 19 and 25. Each end of a sheet is then formed in a roughly U-shaped configuration, the outside portion of which form tangs 24 and 31. The sheet is then folded in half such that the open ends of the U-shaped portions face each other to form the enlarged region for enclosing the short side of the pressed end of envelope 11. The sheet material on the other side of cut-out 25 forms the straight portion which receives a lead wire from the lamp. To further strengthen the clips, suitable reinforcing means such as deformation 32 may be provided in one or more directions along the tab formed adjacent the closed end, i.e. adjacent the line about which the sheet is folded.

There is thus provided by the present invention an improved clip and press end structure which enables the clip to be securely engaged to the glass lamp and provides a lamp suitable for use as the inner bulb in an optical system subject to vibration, such as an automotive headlamp.

Having thus described the invention it will be apparent to those of skill in the art that various modifications can be made within the spirit and scope of the present invention. For example, while a single filament lamp is utilized for purposes of description, a multi-filament lamp may also be used, e.g. by bringing out the hot lead for each additional filament at a point interior to point 26, as illustrated in FIG. 2, such that it extends from the press end of lamp 10 but is not in contact with clips 15 and 16. Such a lamp is supported by the tab portions of clips 15 and 16 and only electrical contact need be made to the additional lead. The single-ended lamp utilized may comprise an incandescent, a glass-halogen, or a quartz-halogen lamp.

What I claim as new and desire to secure by United States Letters Patent is:

1. In a single ended, miniature lamp having at least one filament, at least two lead wires and a pressed end, the improvement comprising:

said pressed end having an elongated, rectangular cross-section and forming a shoulder where said cross-section merges with the bulbous portion of said lamp;

ridges in said pressed end at the ends of said rectangle extending from said shoulder and parallel to the axis of said lamp;

channels in a long side of said pressed end, said channels being approximately parallel to the axis of said lamp and located in the central region of said long side; and two piece, electrically conductive base means wherein each piece comprises a folded sheet having U-shaped portions adjacent each other to define an enlarged region for enclosing a short side of said press end, the outside leg of at least one U engaging one of said channels, said piece defining cut-outs for receiving said ridges and having a straight portion electrically connected to one of said lead wires.

2. The lamp as set forth in claim 1 wherein the outside leg of each U-shaped portion forms a tang engaging respective channels on opposite sides of said pressed end.

3. The lamp as set forth in claim 1 having a ridge at each corner of said rectangle.

4. The lamp as set forth in claim 1 wherein said lamp comprises a halogen cycle lamp.

5. The lamp as set forth in claim 4 wherein said lamp comprises a glass-halogen lamp.

6. The lamp as set forth in claim 5 wherein the outside leg of each U-shaped portion forms a tang engaging respective channels on opposite sides of said pressed end.

7. The lamp as set forth in claim 6 having a ridge at each corner of said rectangle.

* * * * *